US010766742B2

(12) United States Patent
Ikai

(10) Patent No.: US 10,766,742 B2
(45) Date of Patent: Sep. 8, 2020

(54) HYDRAULIC ELEVATOR SAFETY DEVICE, AND METHOD FOR DETECTING OPEN-DOOR TRAVEL ABNORMALITY IN HYDRAULIC ELEVATOR

(71) Applicant: MITSUBISHI ELECTRIC CORPORATION, Chiyoda-ku (JP)

(72) Inventor: Hirofumi Ikai, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 279 days.

(21) Appl. No.: 15/741,369

(22) PCT Filed: Jul. 17, 2015

(86) PCT No.: PCT/JP2015/070553
§ 371 (c)(1),
(2) Date: Jan. 2, 2018

(87) PCT Pub. No.: WO2017/013709
PCT Pub. Date: Jan. 26, 2017

(65) Prior Publication Data

US 2018/0370765 A1 Dec. 27, 2018

(51) Int. Cl.
*B66B 5/00* (2006.01)
*B66B 5/02* (2006.01)
(Continued)

(52) U.S. Cl.
CPC ..... *B66B 5/028* (2013.01); *B66B 1/04* (2013.01); *B66B 5/0031* (2013.01); *B66B 9/04* (2013.01)

(58) Field of Classification Search
CPC ..... B66B 5/028; B66B 1/04; B66B 5/0031; B66B 9/04
(Continued)

(56) References Cited

U.S. PATENT DOCUMENTS 4,785,914 A * 11/1988 Blain ..... B66B 1/24 187/280
6,044,933 A * 4/2000 Johansson ..... B66B 9/04 187/272
(Continued)

FOREIGN PATENT DOCUMENTS

JP 4767193 B2 9/2011
JP 2013-184799 A 9/2013

OTHER PUBLICATIONS

International Search Report dated Oct. 20, 2015 in PCT/JP2015/070553, filed on Jul. 17, 2015.

*Primary Examiner* — David S Warren
(74) *Attorney, Agent, or Firm* — Xsensus LLP

(57) ABSTRACT

A safety device for a hydraulic elevator includes an open-door running prevention unit and a pressure sensor. The open-door running prevention unit includes a memory configured to sequentially store values of the pressure sensor during a period in which the hydraulic elevator is in the open-door state as time-series data. When it is determined that the car speed, detected when the hydraulic elevator is in the open-door state, is equal to or larger than a preset first threshold value, the open-door running prevention unit calculates a differential value between a maximum value and a minimum value of the time-series data stored in the memory in a period of a preset determination time. When the differential value is out of a preset allowable range, the open-door running prevention unit determines that the open-door running abnormality is present, and executes the car braking processing.

9 Claims, 7 Drawing Sheets

(51) Int. Cl.
*B66B 1/04* (2006.01)
*B66B 9/04* (2006.01)

(58) Field of Classification Search
USPC ..... 187/247
See application file for complete search history.

(56) References Cited

U.S. PATENT DOCUMENTS

| | | | | |
|---|---|---|---|---|
| 6,290,026 | B1 * | 9/2001 | Takigawa | B66B 11/008 187/253 |
| 10,227,210 | B2 * | 3/2019 | Lau | B66B 1/30 |
| 10,399,822 | B2 * | 9/2019 | Zhu | B66B 7/027 |
| 2013/0333982 | A1 * | 12/2013 | Haapaniemi | B66B 5/0031 187/275 |
| 2015/0041254 | A1 * | 2/2015 | Finschi | B66B 1/3423 187/247 |
| 2017/0225924 | A1 * | 8/2017 | Lau | B66B 5/0031 |
| 2018/0141782 | A1 * | 5/2018 | Robbins-Capuano | B66B 1/04 |
| 2018/0215579 | A1 * | 8/2018 | Knecht | B66B 5/0031 |
| 2018/0370765 | A1 * | 12/2018 | Ikai | B66B 9/04 |
| 2019/0127177 | A1 * | 5/2019 | Derbarmdiger | B66B 1/26 |
| 2019/0202665 | A1 * | 7/2019 | Lau | B66B 9/02 |
| 2020/0055701 | A1 * | 2/2020 | Lau | B66B 9/003 |

* cited by examiner

HYDRAULIC ELEVATOR SAFETY DEVICE, AND METHOD FOR DETECTING OPEN-DOOR TRAVEL ABNORMALITY IN HYDRAULIC ELEVATOR

TECHNICAL FIELD

The present invention relates to a safety device for a hydraulic elevator with an open-door running prevention function and a method of detecting an open-door running abnormality of a hydraulic elevator, for a hydraulic elevator configured to cause a car to run in a vertical direction by controlling a hydraulic pressure.

BACKGROUND ART

As related-art open-door running prevention units for a hydraulic elevator, there have been proposed a braking method using an emergency stop device (see, for example, Patent Literature 1), a method using a dual check valve (see, for example, Patent Literature 2), and the like.

Each of the open-door running prevention units monitors a position of a car or a speed of the car in an open-door state to determine an abnormal state and performs a braking operation for the car.

CITATION LIST

Patent Literature

[PTL 1] JP 2013-184799 A
[PTL 2] JP 4767193 B2

SUMMARY OF INVENTION

Technical Problem

However, the related art has the following problem. In the hydraulic elevator, the car is liable to be shaken in response to a vibration force applied inside the car. Therefore, when the car is shaken due to a prank done by a passenger, the speed of the car sometimes becomes excessively higher than needed.

Therefore, an abnormality detection speed is required to be set with a tolerance for a speed at the time when the car is shaken so that the open-door running prevention unit is prevented from being erroneously operated due to the shaking of the car caused by the prank. Even when the car is braked based on the abnormality detection speed with the tolerance as described above, the car can be braked with a distance between a car doorway and a hoistway doorway being set such that the passenger is not caught therein.

When the abnormality detection speed is set with the tolerance, however, a deceleration of the car is undesirably increased due to an increase in maximum speed of the car until the braking operation for the car is started. As a result, there is a fear in that the passenger is injured by the braking operation. Thus, it is desired to decrease the deceleration of the car.

The present invention has been made to solve the problem described above, and has an object to provide a safety device for a hydraulic elevator and a method of detecting an open-door finning abnormality of a hydraulic elevator, which are capable of detecting an abnormal downward movement state at a car speed lower than a car speed set for related-art devices and performing car braking processing, thereby decreasing a deceleration of a car and reducing a stopping distance.

Solution to Problem

According to one embodiment of the present invention, there is provided a safety device for a hydraulic elevator, including: an open-door running prevention unit, which is configured to determine presence or absence of an open-door running abnormality based on a detection value of a car speed when the hydraulic elevator is in an open-door state, and to perform car braking processing when it is determined that the open-door running abnormality is present; and a pressure sensor, which is configured to detect a pressure value on a side of a check valve provided in a hydraulic pipe, which is close to a hydraulic tank, in which the open-door running prevention unit includes a memory configured to sequentially store values of the pressure sensor during a period, in which the hydraulic elevator is in the open-door state as time-series data, in which the open-door running prevention unit determines whether or not the car speed detected when the hydraulic elevator is in the open-door state is equal to or larger than a preset first threshold value, in which, when it is determined that the car speed is equal to or larger than the first threshold value, the open-door running prevention unit calculates a differential value between a maximum value and a minimum value of the time-series data stored in the memory in a period from a current time at which the car speed becomes equal to or larger than the preset first threshold value to preset determination time, and in which, when the differential value is out of a preset allowable range, the open-door running prevention unit determines that the the open-door running abnormality is present, and executes the car braking processing.

Further, according to one embodiment of the present invention, there is provided a method of detecting an open-door running abnormality for a hydraulic elevator, which is to be executed by an open-door running prevention unit included in a safety device for a hydraulic elevator, the open-door running prevention unit being configured to determine presence or absence of an open-door running abnormality based on a detection value of a car speed when the hydraulic elevator is in an open-door state and perform car braking processing when it is determined that the open-door running abnormality is present, the method including: a first step of sequentially storing values of a pressure sensor configured to detect a pressure value on a side of a check value provided in a hydraulic pipe, which is close to a hydraulic tank; a second step of determining whether or not the car speed detected when the hydraulic elevator is in the open-door state is equal to or larger than a preset first threshold value; a third step of, when it is determined that the car speed is equal to or larger than the first threshold value in the second step, calculating a differential value between a maximum value and a minimum value of the time-series data stored in the memory in a period from a current time at which the car speed becomes equal to or larger than the first threshold value to preset determination time, and determining whether or not the differential value is out of a preset allowable range; and a fourth step of, when it is determined that the differential value is out of the preset allowable range in the third step, determining that the open-door running abnormality is present, and executing the car braking processing.

Advantageous Effects of Invention

According to the present invention, the abnormal downward movement state can be reliably detected after a car shaking state and the abnormal downward movement state are distinguished from each other in accordance with a magnitude of a detection value of the pressure of the hydraulic pipe between the check valve and the hydraulic tank when the car speed becomes equal to or larger than a set threshold value. As a result, there can be provided a safety device for a hydraulic elevator and a method of detecting an open-door running abnormality of a hydraulic elevator, which are capable of detecting an abnormal downward movement state at a car speed lower than a car speed set for related-art devices and perform car braking processing, thereby decreasing a deceleration of a car and reducing a stopping distance.

DESCRIPTION OF EMBODIMENTS

Now, description is made of a safety device for a hydraulic elevator and a method of detecting an open-door running abnormality of a hydraulic elevator according to exemplary embodiments of the present invention with reference to the drawings.

First Embodiment

Figure 1:
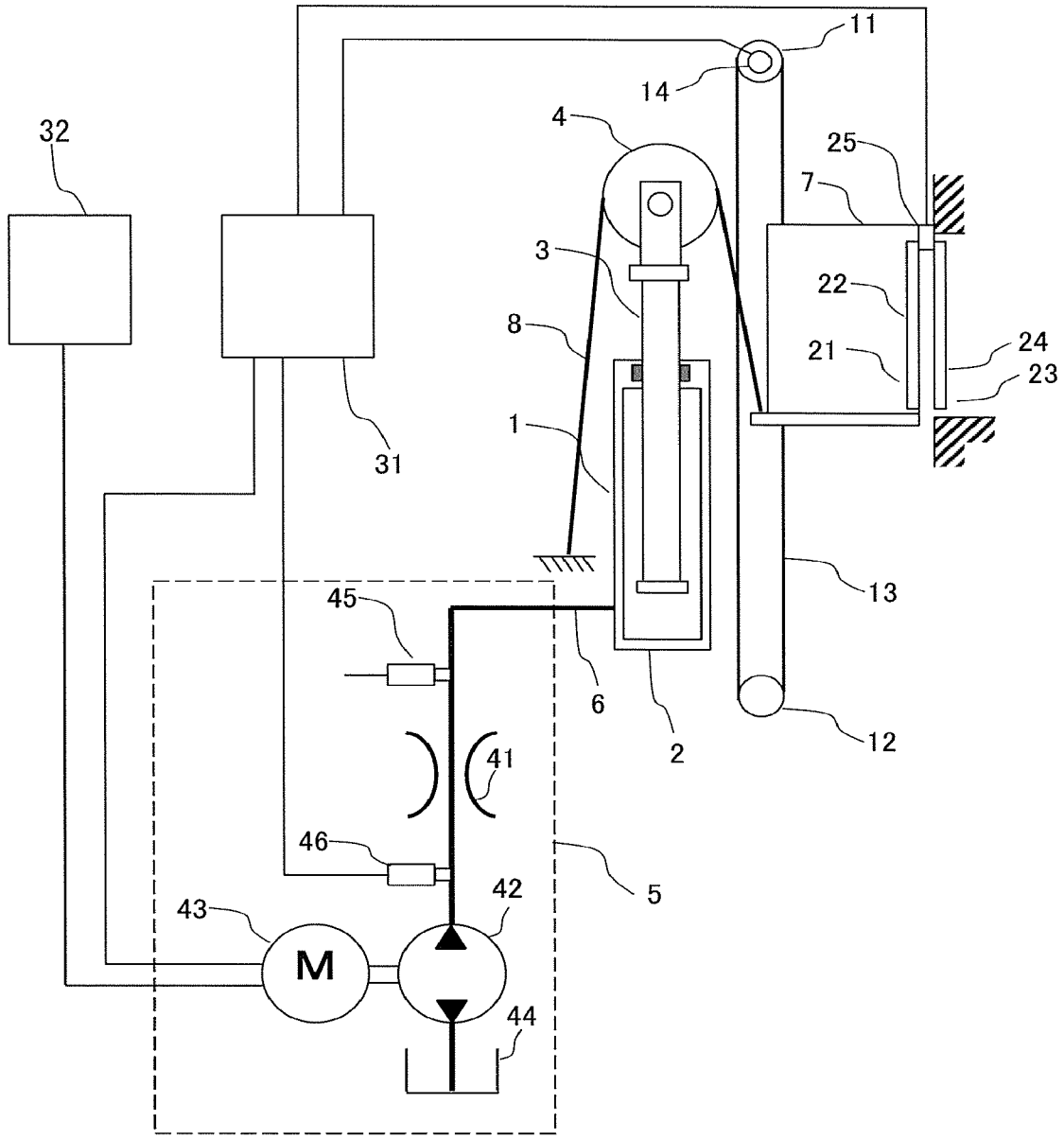
FIG. 1 is an overall configuration diagram of a hydraulic elevator of a first embodiment of the present invention.

FIG. 1 is an overall configuration diagram of a hydraulic elevator of a first embodiment of the present invention. The hydraulic elevator of the first embodiment employs a method of controlling a downward movement operation through control of the number of revolutions of a motor.

In FIG. 1, inside a hoistway, a hydraulic jack 1 is installed. The hydraulic jack 1 includes a cylinder 2 fixed to a bottom portion inside the hoistway and a plunger 3 vertically movable relative to the cylinder 2. A deflector sheave 4 is provided to an upper end portion of the plunger 3 so as to be freely rotatable.

A hydraulic power unit 5 configured to control a hydraulic pressure applied to the cylinder 2 is coupled to the cylinder 2 through a hydraulic pipe 6. The hydraulic power unit 5 of the first embodiment includes a check valve 41, a hydraulic pump 42, a drive motor 43, a tank 44, a jack port pressure sensor 45, and a pressure sensor 46 for determination.

The check valve 41 is provided between the cylinder 2 and the hydraulic pump 42, and is configured to prevent a reverse flow of oil to maintain a hydraulic pressure. The hydraulic pump 42 is driven by the drive motor 43 and is configured to feed the oil stored in the tank 44 to the cylinder 2. The jack port pressure sensor 45 and the pressure sensor 46 for determination are described later.

The hydraulic pressure applied to the cylinder 2 is controlled by rotating the hydraulic pump 42 in a forward direction or a reverse direction with a driving force of the drive motor 43. The drive motor 43 is controlled by a control panel 32. The check valve 41 is controlled to be opened during a period in which a running operation is being performed, and to be closed in a stopped state. The plunger 3 is vertically moved relative to the cylinder 2 by the control of the hydraulic pressure applied to the cylinder 2.

A suspension body 8 configured to suspend a car 7 is caused to run over the deflector sheave 4. As the suspension body 8, for example, a rope or a belt is used. One end portion of the suspension body 8 is connected to the car 7, and another end portion of the suspension body 8 is connected to a fixed portion inside the hoistway. Inside the hoistway, a pair of guide rails (not shown) extending in a vertical direction is installed. The car 7 runs in the vertical direction while being guided by each of the guide rails through the vertical movement of the plunger 3.

In an upper part of the hoistway, an upper sheave 11 is provided. In a lower part of the hoistway, a lower sheave 12 is provided. A rope 13 for detection is caused to run over the upper sheave 11 and the lower sheave 12 in a looped manner. One end portion and another end portion of the rope 13 for detection are connected to the car 7. The rope 13 for detection is moved in accordance with running of the car 7 in the vertical direction. The upper sheave 11 and the lower sheave 12 are rotated in accordance with the movement of the rope 13 for detection.

An encoder 14 configured to detect a position of the car 7 is provided to a rotary shaft of the upper sheave 11. The encoder 14 generates a signal in accordance with the rotation of the upper sheave 11. The position of the car 7 is detected based on the signal generated in accordance with the rotation of the upper sheave 11.

A car doorway 21 is provided to the car 7. The car doorway 21 is opened and closed by movement of a pair of car doors 22 along a width direction of the car doorway 21. Each of the doors 22 of the car is moved by a driving force of a door drive device (not shown) mounted to the car 7.

A landing doorway 23 is provided to a landing on each floor. The landing doorway 23 is opened and closed by movement of a pair of landing doors 24 along a width direction of the landing doorway 23. When the car 7 is stopped within a predetermined landing range, the landing doors 24 and the car doors 22 are mechanically engaged with each other in a horizontal direction by engagement devices (not shown). The landing doorway 23 is opened and closed by the movement of the landing doors 24 held in engagement with the car doors 22.

A landing door switch 25 configured to detect opening of the landing doorway 23 is provided to each landing doorway 23. Each landing door switch 25 detects that the landing doorway 23 is closed when the landing doors are located at positions at which the landing doorway 23 is fully closed. Each landing door switch 25 detects that the landing doorway 23 is opened when the landing doors 24 are located out of the positions at which the landing doorway 23 is fully closed.

A car door switch (not shown) configured to detect opening of the car doorway 21 is provided. The car door switch detects that the car doorway 21 is closed when the car doors 22 are located at positions at which the car doorway 21 is fully closed. The car door switch detects that the car doorway 21 is opened when the car doors 22 are located out of the positions at which the car doorway 21 is fully closed.

An open-door running prevention unit 31 detects the position of the car 7, running of the car 7, a running distance of the car 7, a running direction of the car 7, and a speed of the car 7 based on information from the encoder 14. Further, the open-door running prevention unit 31 detects whether or not at least any of the car doorway 21 and the landing doorways 23 is opened based on information from the car door switch and the landing door switches 25.

Then, the open-door running prevention unit 31 determines whether or not the car 7 is running with the doors open and controls power fed from the hydraulic power unit 5 based on the results of detections described above.

Next, the jack port pressure sensor 45 and the pressure sensor 46 for determination included in the hydraulic power unit for a purpose of detecting a car shaking state are described.

The jack port pressure sensor 45 is provided between the hydraulic jack 1 and the hydraulic power unit 5. Further, the pressure sensor 46 for determination is provided between the check valve 41 and the hydraulic pump 42 which is installed on a side close to the tank 44.

Figure 2:
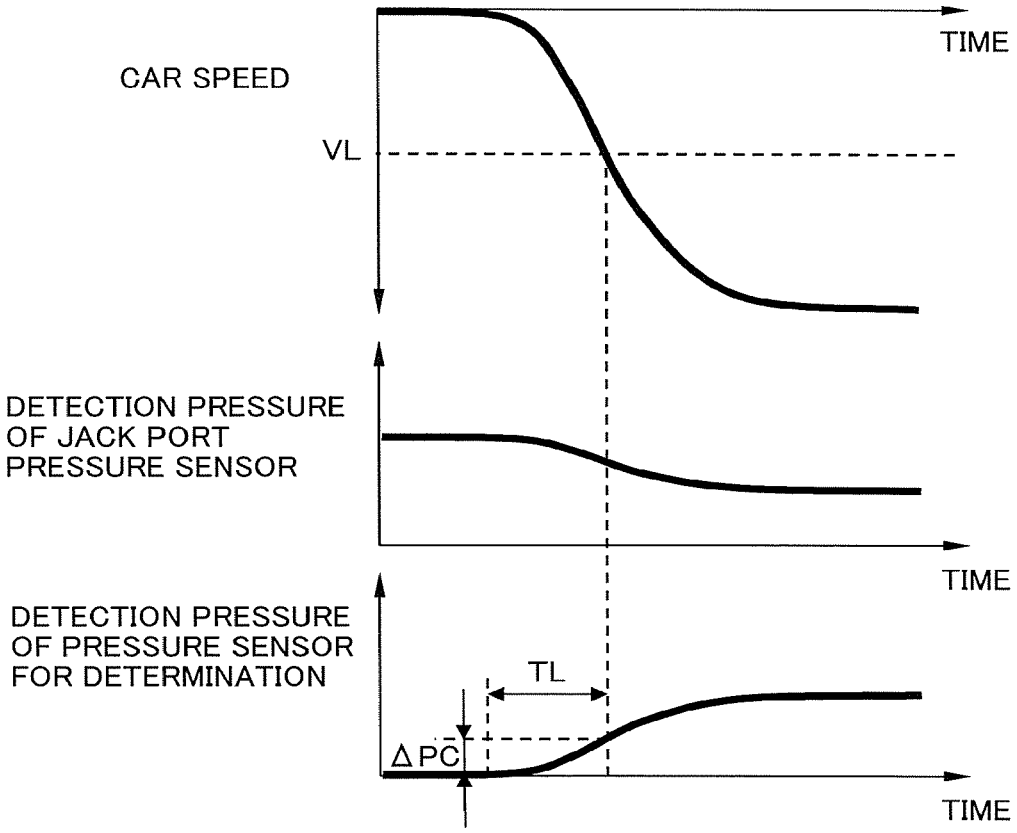
FIG. 2 is a graph for showing a temporal change in car speed, a temporal change in detection pressure of a jack port pressure sensor, and a temporal change in detection pressure of a pressure sensor for determination when an abnormality is present in the hydraulic elevator of the first embodiment of the present invention.

The open-door running prevention unit 31 determines the car shaking state based on the result of detection by the pressure sensor 46 for determination. FIG. 2 is a graph for showing a temporal change in car speed, a temporal change in detection pressure of the jack port pressure sensor 45, and a temporal change in detection pressure of the pressure sensor 46 for determination when an abnormality is present in the hydraulic elevator of the first embodiment of the present invention.

Figure 3:
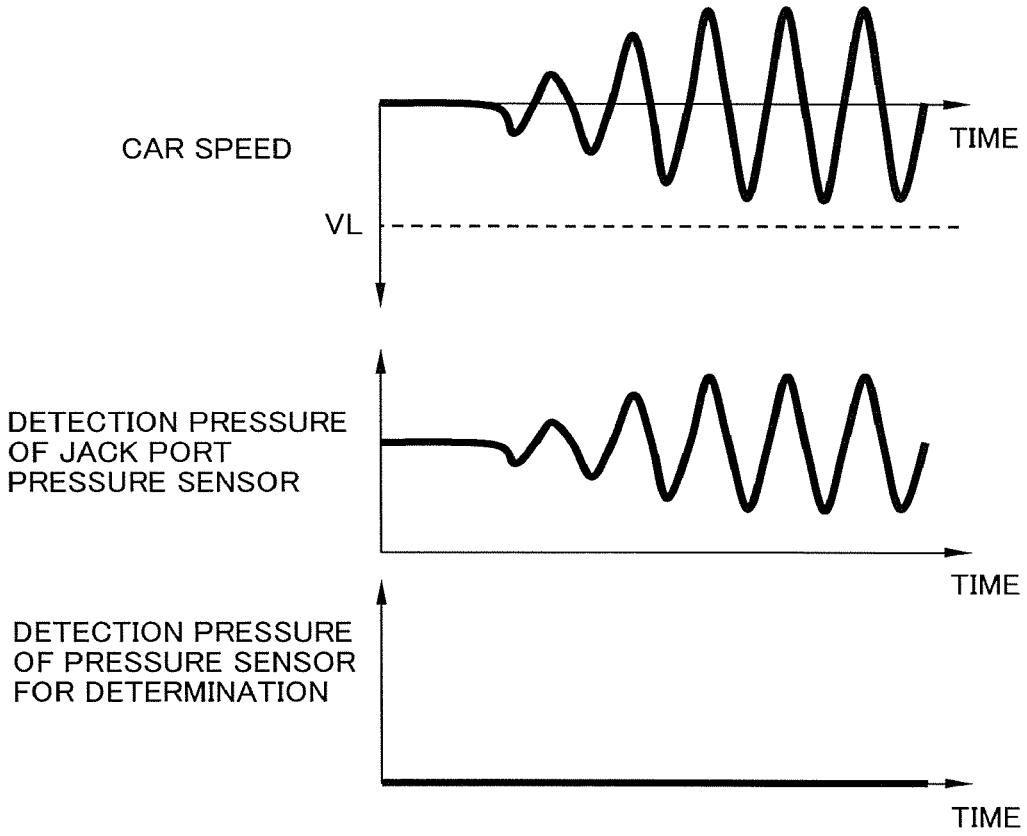
FIG. 3 is a graph for showing a temporal change in car speed, a temporal change in detection pressure of the jack port pressure sensor, and a temporal change in detection pressure of the pressure sensor for determination when a car is shaken under a stopped state with doors open in the hydraulic elevator of the first embodiment of the present invention.

Meanwhile, FIG. 3 is a graph for showing a temporal change in car speed, a temporal change in detection pressure of the jack port pressure sensor 45, and a temporal change in detection pressure of the pressure sensor 46 for determination when the car is shaken under the stopped state with doors open in the hydraulic elevator of the first embodiment of the present invention.

When an abnormality is present in the check valve 41 and an abnormal downward movement state in which the car 7 is lowered is brought about, a pressure loss is generated due to a flow of the oil through the hydraulic pump 42. Therefore, an output of the jack port pressure sensor 45 and an output of the pressure sensor 46 for determination are varied as shown in FIG. 2 along with an increase in speed of the car 7.

In contrast to the above-mentioned case, when the check valve 41 has no abnormality, and the car 7 is shaken due to a prank done by a passenger, the output of the pressure sensor 46 for determination remains unvaried although the speed of the car 7 and the output of the jack port pressure sensor 45 are varied as shown in FIG. 3. Therefore, the open-door running prevention unit 31 can determine that an abnormality is absent in the check valve 41 when the output of the pressure sensor 46 for determination is not varied even though the speed of the car 7 increases or is varied.

Figure 4:
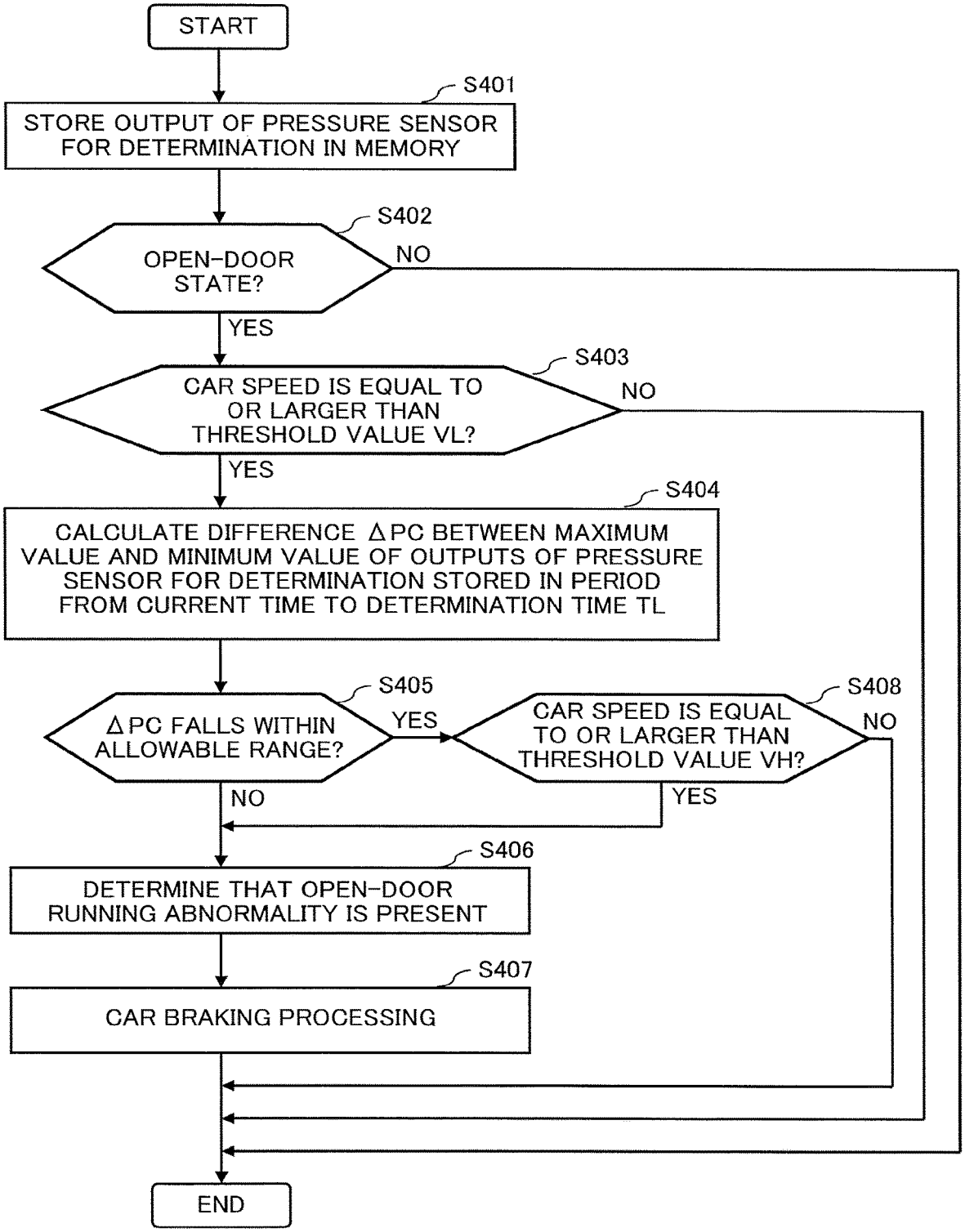
FIG. 4 is a flowchart for illustrating determination processing for a car shaking state and car braking control processing performed along with the determination processing, which are executed by a safety device for a hydraulic elevator according to the first embodiment of the present invention.

FIG. 4 is a flowchart for illustrating determination processing for the car shaking state and car braking control processing performed along with the determination processing, which are executed by the safety device for a hydraulic elevator according to the first embodiment of the present invention. The processing illustrated in FIG. 4 is periodically called so as to be repeatedly executed by the open-door running prevention unit 31.

After the processing is started, the open-door running prevention unit 31 stores an output value of the pressure sensor 46 for determination in a memory in Step S401. Next, in Step S402, the open-door running prevention unit 31 determines whether or not the elevator is in an open-door state based on an operation of the landing door switch 25.

When the elevator is in a closed-door state, the open-door running prevention unit 31 terminates a processing series in this cycle. Meanwhile, when the elevator is in the open-door state, the processing proceeds to Step S403 where the open-door running prevention unit 31 determines whether or not the output of the encoder 14 configured to detect the speed of the car is equal to or larger than a threshold value VL.

When it is determined that the speed of the car is not equal to or larger than the threshold value VL, the open-door running prevention unit 31 terminates the processing series in this cycle. Meanwhile, when it is determined that the speed of the car is equal to or larger than the threshold value VL, the processing proceeds to Step S404 where the open-door running prevention unit 31 calculates a difference ΔPC between a maximum value and a minimum value of the outputs of the pressure sensor 46 for determination, which are stored in the memory in a period from a current time to determination time TL.

As an example of setting of the determination time TL, the determination time TL only needs to be set to a time period about twice to about four times as long as a period of a natural frequency of a target hydraulic elevator. Then, in Step S405, the open-door running prevention unit 31 determines whether or not the difference ΔPC between the maximum value and the minimum value of the outputs of the pressure sensor 46 for determination is out of a preset allowable range as a range including the speed being equal to zero.

Then, when it is determined that the difference ΔPC is out of the allowable range, the processing proceeds to Step S406 where the open-door running prevention unit 31 determines that the open-door finning abnormality is present. Further, in Step S407, the open-door running prevention unit 31 quickly executes braking processing for the car 7 and then terminates the processing series.

Meanwhile, when it is determined that the difference ΔPC falls within the allowable range, the open-door running prevention unit 31 determines that an abnormality is absent in the check valve 41. Even in this case, however, there still is a fear of presence of an abnormality in the pressure sensor 46 for determination or an abnormality which cannot be determined only based on the difference ΔPC falling within the allowable range.

Therefore, when the open-door running prevention unit 31 determines that the difference ΔPC falls within the allowable range, the processing proceeds to Step S408 where it is further determined whether or not the car speed is equal to or larger than a threshold value VH. Here, the threshold value VH is a value larger than the threshold value VL and is preset as an abnormality detection speed with a tolerance with respect to a speed when the car is shaken as in the case of related-art devices.

Then, even when the open-door running prevention unit 31 determines that the speed of the car 7 is equal to or larger than the threshold value VH, the processing proceeds to Step S406 where it is determined that the open-door running abnormality is present. Further, in Step S407, the open-door running prevention unit 31 quickly executes the braking processing for the car 7 and then terminates the processing series.

As described above, the determination processing using the threshold value VH as in the related art is performed in Step S408. As a result, the car 7 can be braked with a distance between the car doorway and the hoistway doorway being set to a distance with which the passenger is not caught therein, as in the related art.

Figure 5:
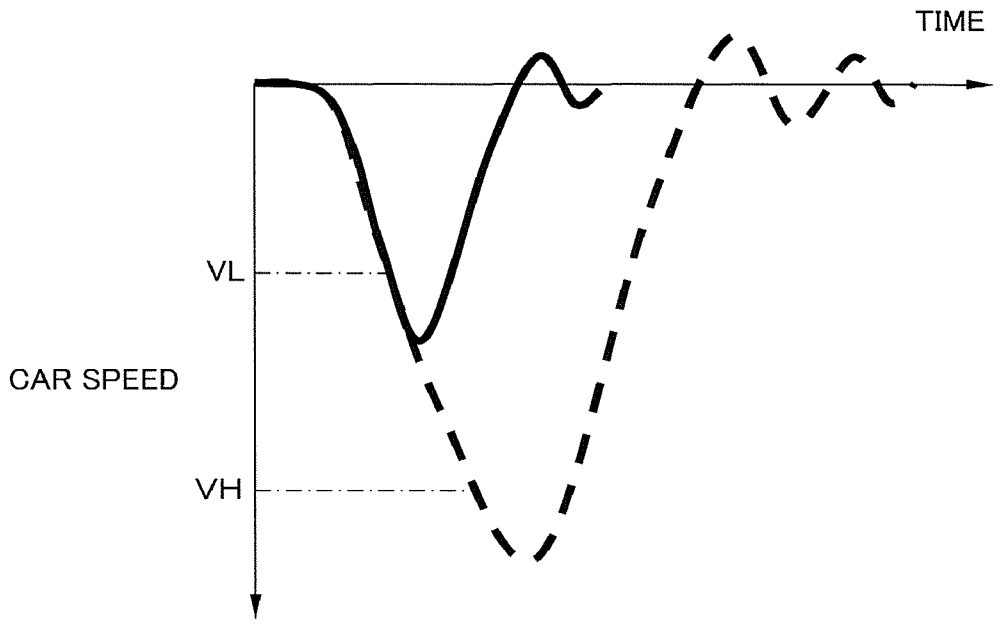
FIG. 5 is a graph for showing a comparison between a car speed waveform when the car is braked with the safety device for a hydraulic elevator according to the first embodiment of the present invention and that with a related-art device.

FIG. 5 is a graph for showing a comparison between a car speed waveform when the car is braked with the safety device for a hydraulic elevator according to the first embodiment of the present invention and that with the related-art device. The solid line in FIG. 5 represents the speed waveform of the present invention, and the dotted line in FIG. 5 represents the speed waveform with the related-art device.

In the case of the related-art device, the presence or absence of the abnormality is determined based on the speed of the car 7 exceeding the threshold value VH. Therefore, from the determination of the abnormality to the start of operation of a braking device, a lowering speed for the car 7 is increased and then, a decelerating operation is performed.

Meanwhile, the safety device for the hydraulic elevator according to the first embodiment, at the time when the speed of the car exceeds the threshold value VL set as the speed lower than the threshold value VH, the difference APC is calculated to perform the determination processing. Therefore, an increase in speed of the car until the start of operation of the braking device can be held smaller than that with the related-art device. As a result, a deceleration of the car to stop the car can also be decreased, and hence the running distance until the stop can also be reduced.

As described above, according to the first embodiment, the abnormal downward movement state can be reliably detected after the car shaking state and the abnormal downward movement state are distinguished from each other based on the speed lower than that used in the related-art devices. As a result, the abnormality detection speed can be decreased. Thus, the deceleration of the car can be made smaller than that with the related-art devices, and a stopping distance can be shortened. Therefore, the safety device for a hydraulic elevator, which is capable of executing more quick and appropriate car braking processing, can be provided.

Second Embodiment

Figure 6:
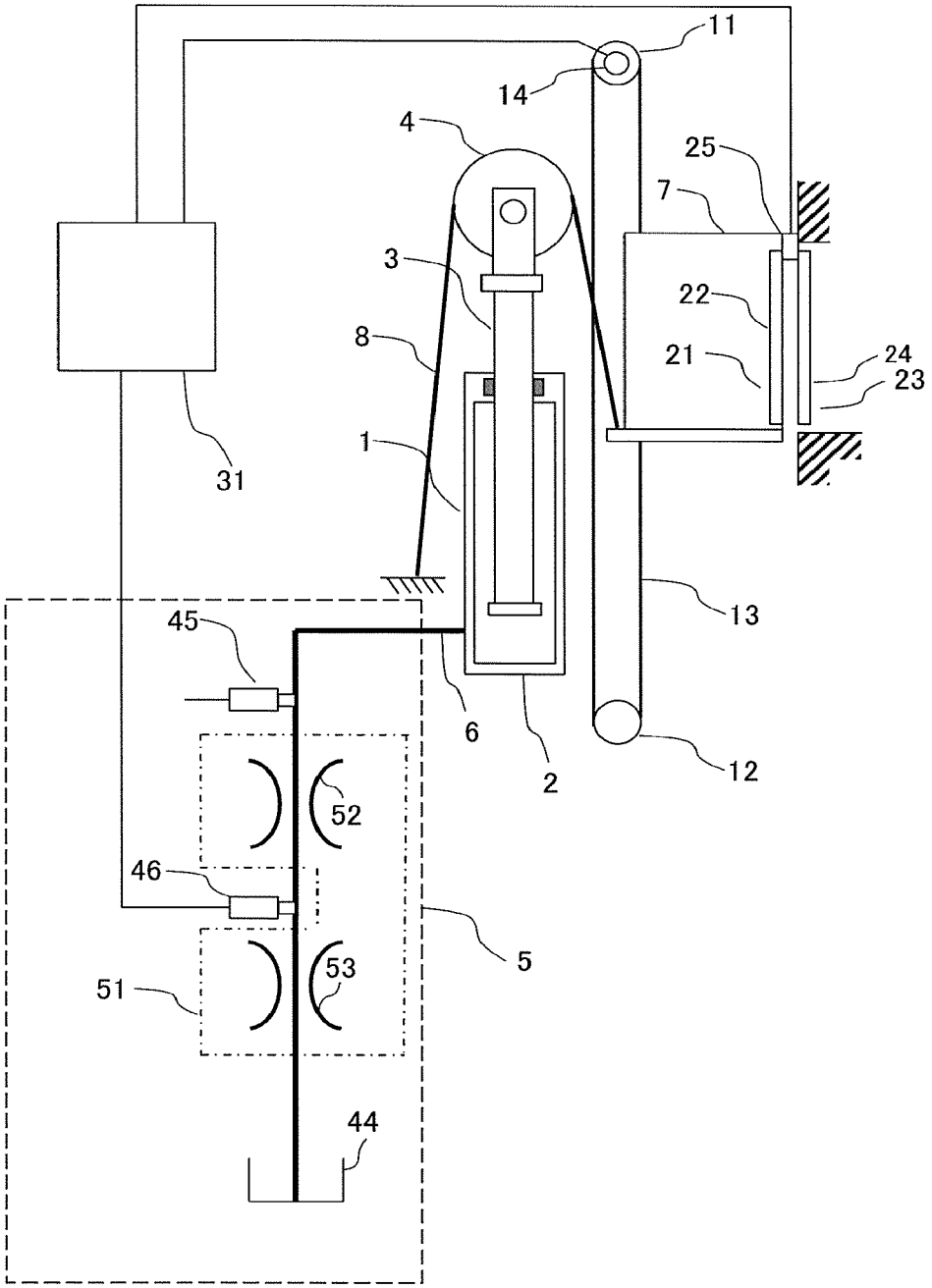
FIG. 6 is an overall configuration diagram of a hydraulic elevator of a second embodiment of the present invention.

FIG. 6 is an overall configuration diagram of a hydraulic elevator of a second embodiment of the present invention. The configuration of FIG. 6 of the second embodiment differs from the configuration of FIG. 1 of the first embodiment described above in an internal configuration of the hydraulic power unit 5. Therefore, differences of the hydraulic power unit 5 are mainly described below.

The hydraulic power unit 5 of the second embodiment includes the tank 44, the jack port pressure sensor 45, the pressure sensor 46 for determination, and a control valve 51. The control valve 51 includes a check valve 52 and a piston 53.

Specifically, the hydraulic power unit 5 of the second embodiment employs a method of controlling the lowering operation with an opening degree of the control valve 51 instead of controlling the hydraulic pump 42 and the drive motor 43.

The pressure sensor 46 for determination is provided between the check valve 52 and the piston 53. Specifically, the pressure sensor 46 for determination of the second embodiment is provided on a side of the check valve 52, which is close to the tank, as in the case of the first embodiment described above. Then, when the car is abnormally lowered, the output of the pressure sensor 46 for determination is varied due to a pressure loss generated by an internal resistance of the piston 53 or the control valve 51.

Therefore, even with the configuration of FIG. 6 described above, the same effects can be obtained by performing the determination processing using the threshold value VL for the output of the pressure sensor 46 for determination as in the case of the first embodiment described above.

Third Embodiment

Figure 7:
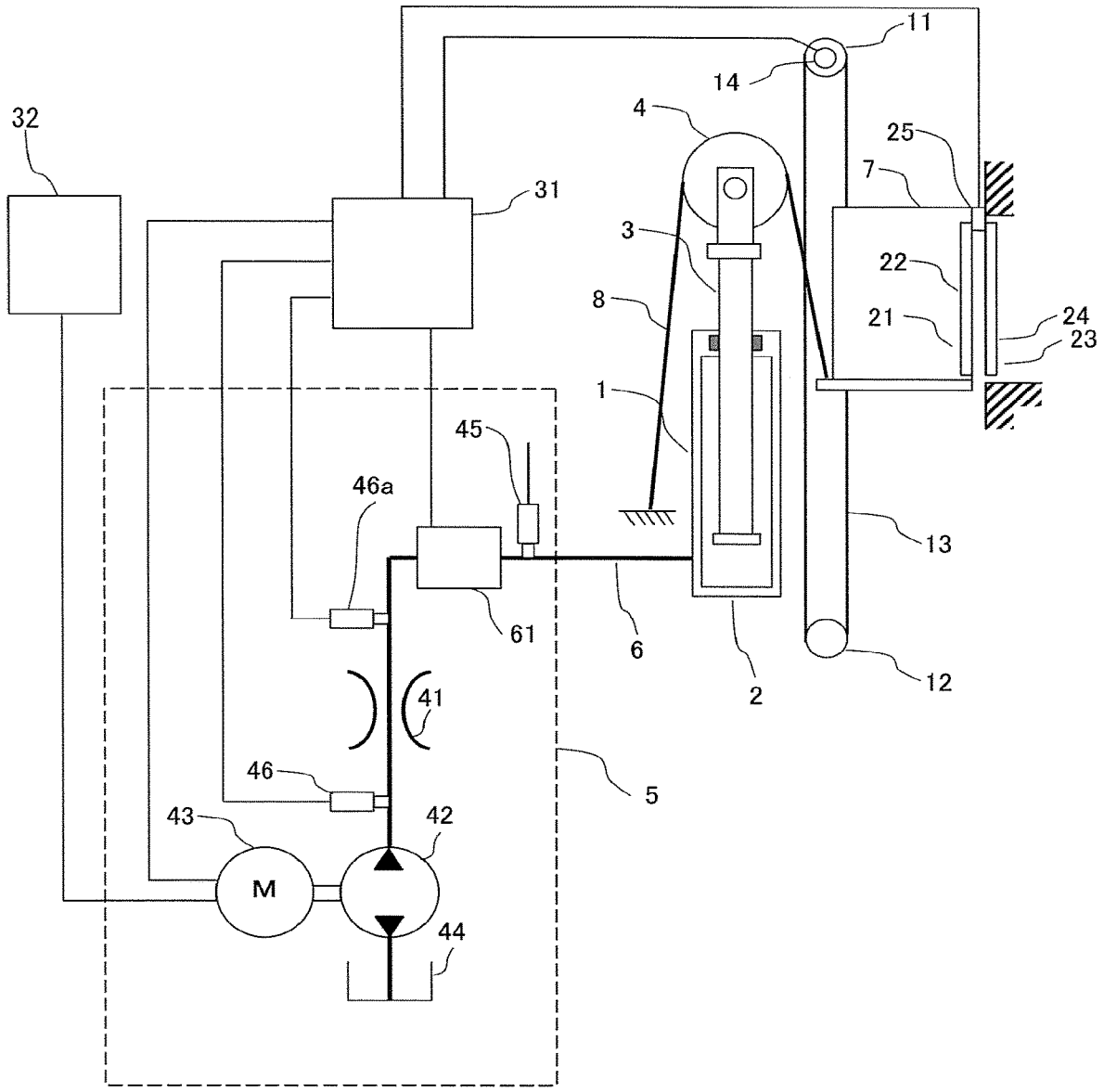
FIG. 7 is an overall configuration diagram of a hydraulic elevator of a third embodiment of the present invention.

FIG. 7 is an overall configuration diagram of a hydraulic elevator of a third embodiment of the present invention. The configuration of FIG. 7 of the third embodiment differs from the configuration of FIG. 1 of the first embodiment described above in an internal configuration of the hydraulic power unit 5. Therefore, differences of the hydraulic power unit 5 are mainly described below.

The hydraulic power unit 5 of the third embodiment further includes a dual check valve 61 in addition to the check valve 41, the hydraulic pump 42, the drive motor 43, the tank 44, the jack port pressure sensor 45, and the pressure sensor 46 for determination.

The dual check valve 62 is used under a closed state. Therefore, in place of the pressure sensor 46 for determination of the first embodiment described above, a second pressure sensor 46*a* for determination may be provided between the dual check valve 61 and the check valve 41. In FIG. 7, there is exemplified a case where the pressure sensor 46 for determination and the second pressure sensor 46*a* for determination are both provided.

Therefore, even with the configuration of FIG. 7 described above, the same effects can be obtained by performing the determination processing using the threshold value VL for the output of the pressure sensor 46 for determination or for the output of the second pressure sensor 46*a* for determination as in the case of the first embodiment and the second embodiment described above.

The invention claimed is:

1. A safety device for a hydraulic elevator, comprising:

an open-door running prevention means for determining a presence or an absence of an open-door running abnormality based on a detection value of a car speed when the hydraulic elevator is in an open-door state, and for performing car braking processing when it is determined that the open-door running abnormality is present; and a pressure sensor, which is configured to detect a pressure value on a side of a check valve provided in a hydraulic pipe, which is close to a hydraulic tank, wherein the open-door running prevention means comprises a memory that is configured to sequentially store values of the pressure sensor during a period in which the hydraulic elevator is in the open-door state as time-series data, wherein the open-door running prevention means determines whether or not the car speed detected when the hydraulic elevator is in the open-door state is equal to or larger than a preset first threshold value, wherein, when it is determined that the car speed is equal to or larger than the first threshold value, the open-door running prevention means calculates a differential value between a maximum value and a minimum value of the time-series data stored in the memory in a period from a current time at which the car speed becomes equal to or larger than the preset first threshold value to a preset determination time, and wherein, when the differential value is out of a preset allowable range, the open-door running prevention means determines that the open-door running abnormality is present, and executes the car braking processing.

2. A safety device for a hydraulic elevator according to claim 1, wherein the determination time is preset as time twice to four times as long as a period of a natural frequency of a target hydraulic elevator for which the open-door running abnormality is to be detected.

3. A safety device for a hydraulic elevator according to claim 1, wherein the open-door running prevention means further determines whether or not the car speed detected, when the hydraulic elevator is in the open-door state, is equal to or larger than a preset second threshold value, wherein, when it is determined that the car speed is equal to or larger than the second threshold value, the open-door running prevention means determines that the open-door running abnormality is present, and executes the car braking processing, and wherein the first threshold value is preset as a value smaller than the second threshold value.

4. A method of detecting an open-door running abnormality for a hydraulic elevator, the method comprising:

sequentially storing values of a pressure sensor configured to detect a pressure value on a side of a check value provided in a hydraulic pipe, which is close to a hydraulic tank;

determining whether or not a car speed detected, when the hydraulic elevator is in an open-door state, is equal to or larger than a preset first threshold value;

calculating, when it is determined that the car speed is equal to or larger than the first threshold value in the second step, a differential value between a maximum value and a minimum value of time-series data stored in a memory in a period from a current time at which the car speed becomes equal to or larger than the first threshold value to a preset determination time, and determining whether or not the differential value is out of a preset allowable range; and determining, when it is determined that the differential value is out of the preset allowable range, that the open-door running abnormality is present, and executing a car braking processing.

5. A safety device for a hydraulic elevator according to claim 1, wherein the open-door running prevention means determines whether or not the car speed detected, when the hydraulic elevator is in the open-door state, is equal to or larger than a preset second threshold value, wherein, when it is determined that the car speed is equal to or larger than the second threshold value, the open-door running prevention means determines that the open-door running abnormality is present, and executes the car braking processing, and wherein the first threshold value is preset as a value smaller than the second threshold value.

6. A safety device for a hydraulic elevator, comprising:

open-door running prevention circuitry, which is configured to determine presence or absence of an open-door running abnormality based on a detection value of a car speed when the hydraulic elevator is in an open-door state, and to perform car braking processing when it is determined that the open-door running abnormality is present; and a pressure sensor, which is configured to detect a pressure value on a side of a check valve provided in a hydraulic pipe, which is close to a hydraulic tank, wherein the open-door running prevention circuitry comprises a memory that is configured to sequentially store values of the pressure sensor during a period in which the hydraulic elevator is in the open-door state as time-series data, wherein the open-door running prevention circuitry determines whether or not the car speed detected when the hydraulic elevator is in the open-door state is equal to or larger than a preset first threshold value, wherein, when it is determined that the car speed is equal to or larger than the first threshold value, the open-door running prevention circuitry calculates a differential value between a maximum value and a minimum value of the time-series data stored in the memory in a period from a current time at which the car speed becomes equal to or larger than the preset first threshold value to a preset determination time, and wherein, when the differential value is out of a preset allowable range, the open-door finning prevention circuitry determines that the open-door running abnormality is present, and executes the car braking processing.

7. A safety device for a hydraulic elevator according to claim 6, wherein the determination time is preset as time twice to four times as long as a period of a natural frequency of a target hydraulic elevator for which the open-door running abnormality is to be detected.

8. A safety device for a hydraulic elevator according to claim 6, wherein the open-door running prevention circuitry determines whether or not the car speed detected, when the hydraulic elevator is in the open-door state, is equal to or larger than a preset second threshold value, wherein, when it is determined that the car speed is equal to or larger than the second threshold value, the open-door running prevention circuitry determines that the open-door finning abnormality is present, and executes the car braking processing, and wherein the first threshold value is preset as a value smaller than the second threshold value.

9. A safety device for a hydraulic elevator according to claim 6, mwherein the open-door running prevention circuitry determines whether or not the car speed detected, when the hydraulic elevator is in the open-door state, is equal to or larger than a preset second threshold value, wherein, when it is determined that the car speed is equal to or larger than the second threshold value, the open-door running prevention circuitry determines that the open-door running abnormality is present, and executes the car braking processing, and wherein the first threshold value is preset as a value smaller than the second threshold value.

* * * * *